US009845231B2

(12) United States Patent
Hume

(10) Patent No.: US 9,845,231 B2
(45) Date of Patent: Dec. 19, 2017

(54) CORK EXTRACTOR

(71) Applicant: True Fabrications, Inc., Seattle, WA (US)

(72) Inventor: Ryan William Hume, Seattle, WA (US)

(73) Assignee: TRUE FABRICATIONS, INC., Seattle, WA (US)

( * ) Notice: Subject to any disclaimer, the term of this patent is extended or adjusted under 35 U.S.C. 154(b) by 300 days.

(21) Appl. No.: 14/933,725

(22) Filed: Nov. 5, 2015

(65) Prior Publication Data

US 2017/0129758 A1 May 11, 2017

(51) Int. Cl.
*B67B 7/08* (2006.01)

(52) U.S. Cl.
CPC ..... *B67B 7/08* (2013.01)

(58) Field of Classification Search
CPC B67B 7/08; B65B 31/08; B65B 31/04; B65B 31/06
See application file for complete search history.

(56) References Cited

U.S. PATENT DOCUMENTS 6,622,595 B1 * 9/2003 Federighi ..... B67B 7/08 7/155
6,941,839 B1 * 9/2005 Syu ..... B67B 7/08 81/3.2
7,234,375 B1 * 6/2007 Wang Wu ..... B67B 7/08 81/3.2
7,454,883 B2 * 11/2008 Hoyt ..... B67B 7/08 53/431
9,446,936 B2 * 9/2016 Kao ..... B67B 7/08
2003/0217621 A1 * 11/2003 Su ..... B67B 7/08 81/3.09

* cited by examiner

*Primary Examiner* — David B Thomas
(74) *Attorney, Agent, or Firm* — Vicky Kaur Bajwa

(57) ABSTRACT

An extractor device for use with a removable compressed fluid container having a containing section, sliding section, positioning section, and a hollow needle. A method of extracting a cork from a bottleneck utilizing a compressed fluid injected from a removable container, housed within a containing section of the device, to the bottle through a hollow needle affixed to the containing section of the device. The cork extractor device can include a rotationally projected component to forcibly displace a removed cork from the needle.

21 Claims, 10 Drawing Sheets

CORK EXTRACTOR

FIELD OF THE INVENTION

The present invention generally relates to an improvement of a cork extractor for wine bottles and the like, and more particularly, an improvement of cork extractors of the type that extract the cork by injecting pressurized fluid into a bottle or the like.

BACKGROUND

Additionally, the use of a worm compromises the integrity of the cork. A cork could fragment during the extraction process if the worm is not properly placed in the center of the cork or if improperly driven through the cork in an angled manner. This could require multiple attempts to extract the cork and potentially an altogether failed extraction. Even with proper use, the worm displaces a distinct portion of the cork creating the potential for particles of cork to fall into the wine contained therein creating impurities. Furthermore cork preservation is a benefit that also serves wine consumers who use the original cork to recork or "stop" the bottle and those who keep corks for display or craft purposes.

Many improvements have been made to overcome the shortcomings of the traditional corkscrew. Recently electric openers eliminate the leverage function, however these extractors still use a worm to penetrate the cork and the use of a worm inherently requires the bottle opener to be rotationally driven through the cork, thereby requiring a second hand to stabilize the bottle. Therefore, these methods only eliminate part of the problems inherent in the traditional corkscrew.

Inventors acknowledge that use of a needle to inject compressed fluid into the wine bottle to extract the cork is an up and coming solution for eliminating the worm and to avoid leveraging the bottle for cork removal. However, extractors incorporating injected compressed fluid leave significant room for improvement. For example, other extractors provide minimal guidance for centering the needle through the surface area of the cork, such that cork removal maybe be hindered and preservation of the cork maybe comprised by not maintaining a linear or central path through the cork.

Alternatively, in products where the extractor provides a guide to position the needle over the center of the surface area of the cork, the needle is rotationally driven through the cork. This rotational penetration reintroduces the need for more physical effort to penetrate the cork, the potential of compromising the cork, and the requirement to stabilize the bottle with the use of both hands.

An additional problem is that due to the length of needle required to penetrate through the length of the cork, the needle often remains exposed posing a safety hazard to users while the extractor is not engaged with the bottle. A few inadequate designs offer to address this issue by extending a component of the device to extend the length of the needle, however, in these embodiments the needle is not guarded from all directions and still remains fully exposed on more than one side while the extractor is in a resting positioning. This exposure is more than sufficient to allow access to the needle by various body parts.

Furthermore, any shield extending around the needle is limited by the height of the bottleneck. Since the needle must inherently be of a length that extends at least partially beyond the length of the cork to inject fluid into the bottle, this would result in a portion of the sharp end of the needle remaining exposed. One inadequate design introduces a shield that slides down to cover the needle. However, the jacket is free to slide back and forth. Therefore, when the extractor is inverted, the jacket will slide toward the top of the device exposing the needle while the device is in a resting state impeding the efficacy of the safety mechanism.

Further, previous extractors typically rely on the user to forcibly pull an extracted cork from the needle. This results in physical exertion and creates a potentially dangerous scenario due to the exposed needle.

Thus, a need exists for a cork exactor using injected compressed fluid which is capable of single-handed cork extraction, a mechanical means for removing an extracted cork from the needle, and additional safety features.

SUMMARY OF THE INVENTION

The present invention overcomes the shortcomings associated with old devices and methods, and achieves other advantages not realized by conventional devices and methods.

In view of the foregoing disadvantages in the known types of cork extractors, an objective of the present invention provides a novel structural improvement for a cork extraction device that injects compressed fluid into a corked bottle to eject the cork out of the bottleneck, particularly by introducing a safer structure, with reduced exposure to the needle, and simpler method of use, where cork extraction requires only the use of one hand; wherein the same extraction device minimizes the need for applying a countervailing force to a bottle during cork extraction to offset the force applied to lift a cork out the bottle.

Described herein is an extraction device composed of an elongated body. The elongated body having a containing section, a sliding section, and a positioning section to engage with the bottle. The containing section and slide section are adapted to slidably engage with one another. The containing section is adapted to receive a typically cylindrical compressed fluid container. An elongated hollow needle is affixed to the containing section and extends longitudinally through the device, such that the fluid can pass from the compressed fluid container to the bottle. In a first embodiment of the extraction device, a resistance means is housed within the sliding section to urge the device into a decompressed state.

The general operation behind an extractor of this type, is that the compressed fluid is released, passes through the hollow needle into the corked wine bottle. As the release fluid expands to a gaseous state, the pressure in the wine bottle increases, forcing the friction-fitted cork out of the bottle onto the needle. A second embodiment of the extraction device includes a rotational cork removal mechanism for removing an extracted cork from the needle.

It is an aspect of the invention to provide a mechanism for positioning the needle centrally through the cork for optimal removal and to further stabilize the bottle to facilitate single-handed use of the extraction device. This and other aspects of the invention are accomplished by a positioning section at the terminal end of the extraction device operating in conjunction with a resistance means. The positioning section extends beyond the tip of the needle, therefore when the positioning section engages the bottle neck it locates the needle tip above the approximate center of the cork. When the needle is driven into the cork, the positioning section maintains engagement with the bottleneck, thereby stabilizing the bottle without requiring the user's other hand. It is an advantage of the present invention that the resistance means not only introduces a safety feature, but, until a counteracting force is applied, the resistance means maintains the extraction device in a decompressed state, wherein the positioning section is spatially separated from the containing section. Absent the resistance means, the minimal pressure of simply placing the positioning section on the bottleneck would cause the sliding section to slidably retract along the containing section, thereby causing the device to collapse about the needle. Thus, leaving the needle tip as the first component of the extraction device to engage with the cork and thereby negating the alignment and stabilization functions of the extractor device.

The discussed resistance means can be any resilient method with a resistance greater than the gravitational force of the containing section and container, to urge the containing section away from the positioning section, but less than the strength of the press fit relationship between the needle and the cork, to prevent the needle from retracting out of the cork before cork extraction is complete.

It is also an aspect of the invention to provide a method and mechanism to facilitate removal of an extracted cork from the needle, upon which the cork transverses during extraction. Natural wine cork is comprised of a buoyant material. Synthetic corks are intended to mimic this quality. Once disposed in the bottleneck, the elasticity of the cork material causes the cork to expand creating a tight seal in the bottleneck. Once a needle is driven through the cork, the same press fit relationship is inherited between the needle and the cork, creating a tight seal. Therefore, removal of an extracted cork from the needle would require great physical exertion if manually attempted by a user. Manual removal also creates a safety issue that is inherent when you combine sharp objects and uncontrolled physical movement.

To accomplish this aspect of the invention, a second embodiment of the extractor device implements a tubular sleeve fitted to axially extend and retract along the length of the needle from the positioning section. As the tubular sleeve is extended, the sleeve abuts against the cork forcibly sliding it towards the tip of the needle, thereby facilitating removal. In a third embodiment of the invention, the features of both the first and second embodiments are combined. In this embodiment, the resistance means urges the device from a compressed state to a decompressed state, therefore the resistance means provides yet another way of accomplishing facilitation of the removal of an extracted cork from the needle as it provide a resistance force in the same linear direction along the needle as it returns to its natural decompressed state.

Any sharp kitchen tool poses inherent risks, however it is important to minimize exposed parts/the exposure to those risk as much as possible. Thus, it is also an advantage of the invention to provide enhanced safety to the user when the device is not in use. In a decompressed state, the resistance means of the first embodiment of the extraction device maintains the extractor device in a decompressed state, wherein the needle is fully coaxially covered by the length of the device. If used properly, when the device is placed over the bottle, the bottle positioner engages with the bottle neck, a downward force is applied to the containing section thereby driving the needle down to penetrate through the cork. Therefore, the needle point is not exposed to the user until the cork is removed. Yet another way of accomplishing enhanced safety in a second and third embodiment of this invention, because the tubular sleeve of the removal mechanism extends at least to the tip of the needle, the device can also be stored with the tubular sleeve fully extended when the extractor device is not in use, thereby shielding the needle.

It is also an advantage of the invention to eliminate rotation of the needle through the cork to maintain cork integrity and to eliminate the need of a second hand to stabilize the bottle, by providing a linear path of movement, since any rotational method of penetrating the cork would inherently require the bottle to be stabilized to facilitate rotation. These and other aspects of the invention are accomplished by the containing section slidably engaging with the sliding section, thereby allowing axial penetration of the needle through the cork. Other embodiments may include a guide on the containing section that travels along a corresponding linear path, along the length of the sliding section, to prevent the sliding section and containing section from inadvertently rotationally engaging.

Other independent features and advantages of the invention will become apparent from following detailed description, taken in conjunction with the accompanying drawings which illustrate, by way of example, the principles of the invention. Various changes and modifications within the spirit of the invention will become apparent to those skilled in the art.

In this respect, before explaining at least one embodiment of the invention in detail, it is to be understood that the invention is not limited in its application to the details of construction set forth in the following description or illustrated in the drawings. The invention is capable of other embodiments and of being practiced and carried out in various ways or with various materials. Also, it is to be understood that the phraseology and terminology employed herein are for the purpose of description and should not be regarded as limiting.

DETAILED DESCRIPTION

Figure 1:
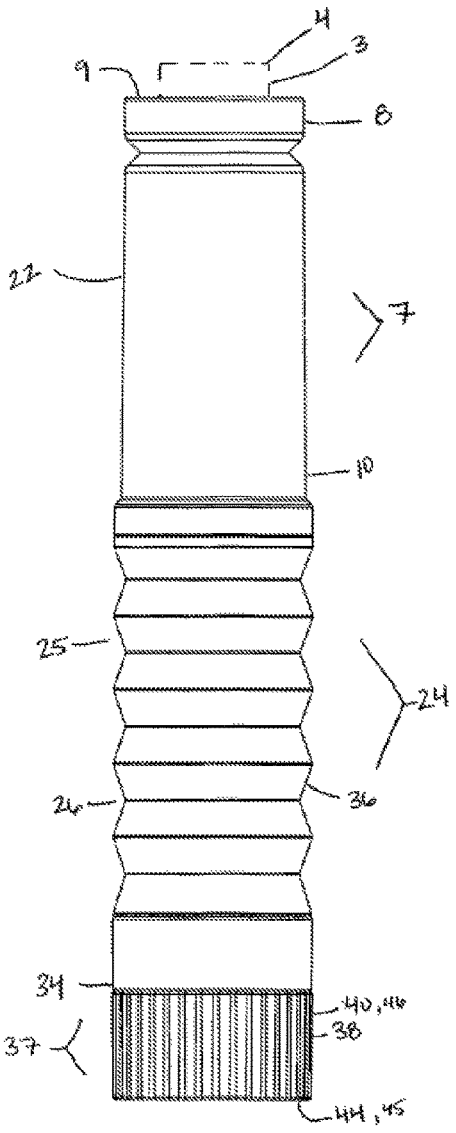
FIG. 1 is a diagrammatic front view of an exemplary embodiment of the present invention.

The following descriptions are exemplary embodiments only, and are not intended to limit the scope, applicability or configuration of the invention in any way. Various changes to the described embodiments may be made in the function and arrangement of the elements described without departing from the scope of the invention as set forth in the appended claims.

The present invention is directed towards an extractor device and a method of extracting a cork 2 from a bottleneck 1 utilizing a compressed fluid injected from a removable container 3, housed within a containing section 7 of the device, to the bottle 1 through a hollow needle 15 affixed to the containing section 7 of the device. With reference to the annexed drawings, the preferred embodiments of the present invention are herein described for indicative purposes and by no means as a limitation.

Overall Invention

In describing the contents of a corked bottle 1 in all the embodiments, the terms beverage, liquid and wine will be used interchangeably. Thus, in every instance, the use of the terms are not limited to wine but are to be read to include any liquid contained in a corked bottle 1.

The composition of the compressed fluid, the compressed fluid container 3, and the hollow needle 15 are not a claimed feature of the present invention.

Compressed Fluid

The composition of the gas in the present invention can be any composition having a gaseous state at atmospheric pressure that is stable, non-flammable, and minimally toxic. Compressed air or other gases that remain in gaseous form at high pressures due to its higher boiling point could be used. However, because gas occupies more space in the container 3 than a liquid, more containers 3 would be required for similar use resulting in less efficient use and higher cost to the consumer. Therefore, a gas having a boiling point below ambient temperature that converts to liquid when pressurized is preferred.

Differing compositions of the compressed fluid will have varying properties. Some compressed fluids will change to a liquid phase when compressed at very high pressures (e.g. CO2), however these compositions would require a robust container 3 and often dissipate so quickly that the container 3 cannot be easily resealed without a regulator or other mechanism. Therefore, a preferred compressed fluid changes phases at a reasonably low pressure thereby gradually returning to gaseous form while the liquid travels from the container 3 to the wine bottle 1. Exemplary compressed fluids are tetraflouroethane or chlorofluorocarbons. Other exemplary compressed fluids will be known to those skilled in the art.

Container 3

The compressed fluid container 3 utilized with this device is readily available to consumers and comprises a predominantly cylindrical container 3 closed on a first end 4 and internally sealed on a second end 5 with a valve actuated by the depression of an outlet tube 6 protruding from the second end 5 of the container 3. When the hollow tube is forcibly recessed into the container 3, the valve is actuated, thereby releasing fluid through the outlet tube 6. When pressure is released from the outlet tube 6, the outlet tube 6 returns to its natural fully protruded state and the valve seals, cutting off the flow of fluid. One skilled in the art may enhance features of the compressed fluid container 3 while maintaining this basic function.

Needle 15

A preferred hollow needle 15 would have a blunt end 16 and piercing end 19, with a fluid passageway 18 having the open blunt end 16 as an inlet hole 17 and an outlet hole 20 near the piercing end 19, understanding it may not be feasible have the outlet hole 20 at the tip of the needle 15. The piercing end 19 shall be sharp enough to puncture any foil wrapping over the bottleneck 1.

The needle 15 should be of sufficient length to penetrate through the cork 2 such that the outlet hole 20 of the needle 15 is fully within the open space in the bottle 1 when the extractor is in a compressed state. The needle 15 should not be so long that the outlet of the needle 15 is submerged in the liquid contained with the bottle 1. For optimal safety, in the preferred embodiment the needle 15 meets the previously stated limitations and further is of a length that the needle 15 does not extend past the lower end 10 of the positioning section 37 when the extractor is in a decompressed state.

As described herein, the blunt end 16 of the needle 15 affixes to the base of the containing section 7. In the preferred embodiment, the blunt end 16 of the needle 15 has a smooth exterior and is press fitted or otherwise mated to the fluid channel outlet 14 to create a tight and continuous path for the fluid to travel without significant leakage. In an alternate embodiment, the blunt end 16 of the needle 15 may have a threaded exterior and tightly screwed into the fluid channel outlet 14.

FIGS. 1-8 depict a first embodiment of the extractor device wherein the primary function is extraction of the cork 2 based upon an improved structure. The extractor device includes a containing section 7 housing a compressed fluid container 3, a long hollow needle 15 affixed to the containing section 7 and extending longitudinally through a sliding section 24, a resistance means 28 housed in a sliding section 24 that is adapted to slidably engage with the containing section 7, and a positioning section 37 to engage with the bottle 1.

The general operation behind an extractor of this type is that a user grips the extractor device in a decompressed state with one hand, places the extractor device over the bottleneck 1 of a corked bottle 1, and applies a downward force against the resistance means 28 to penetrate the needle 15 through the cork 2. Once the extractor device is in this compressed state and the needle outlet 33 is exposed in the open section of the bottle 1. The user, then uses the thumb of the same hand to apply downward pressure on the compressed fluid container 3. The compressed fluid is released and passes through the hollow needle 15 into the corked wine bottle 1. The pressure in the wine bottle 1 increases, forcefully displacing the cork 2 from the bottleneck 1 onto the needle 15.

Containing Section 7

The containing section 7 has an open upper end 8, an inner cavity 9, and a lower end 10. The inner cavity 9 is adapted to receive a compressed fluid container 3. In an exemplary embodiment, the inner cavity 9 has a substantially circular cross-section with a diameter slightly larger than the diameter of the compressed fluid container 3 to allow the compressed fluid container 3 to be easily removed. Further, the containing section 7 is of a length such that the first end 4 of a fully received compressed fluid container 3 sits slightly below or above the open upper end 8 of the containing section 7 for accessibility to allow a user to manually apply pressure to the container 3, preferably with the user's thumb. For ease of removal, the preferred embodiment of the containing section 7 is dimensioned to allow the containing section 7 to extend slightly above the open upper end 8 of the containing section 7.

Figure 2:
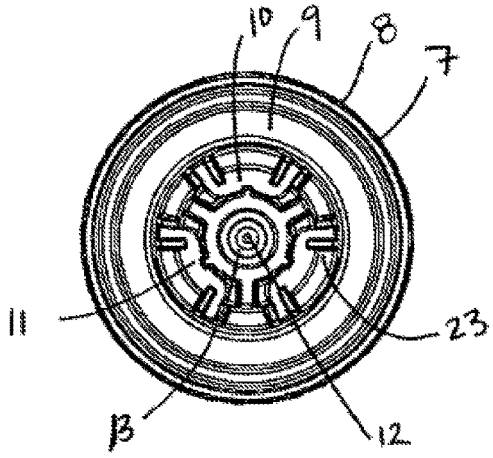
FIG. 2 is a diagrammatic top view of the embodiment of FIG. 1.
Figure 3:
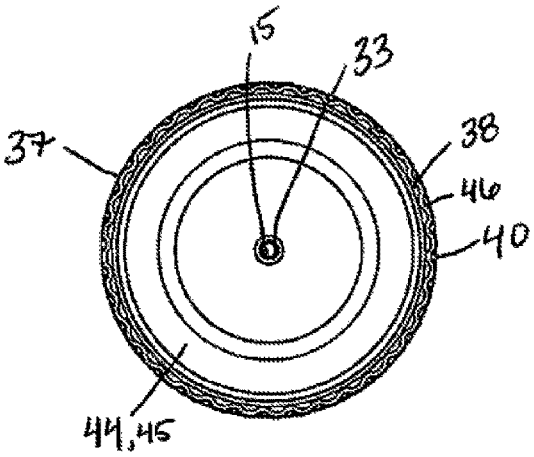
FIG. 3 is a diagrammatic bottom view of the embodiment of FIG. 1.
Figure 4:
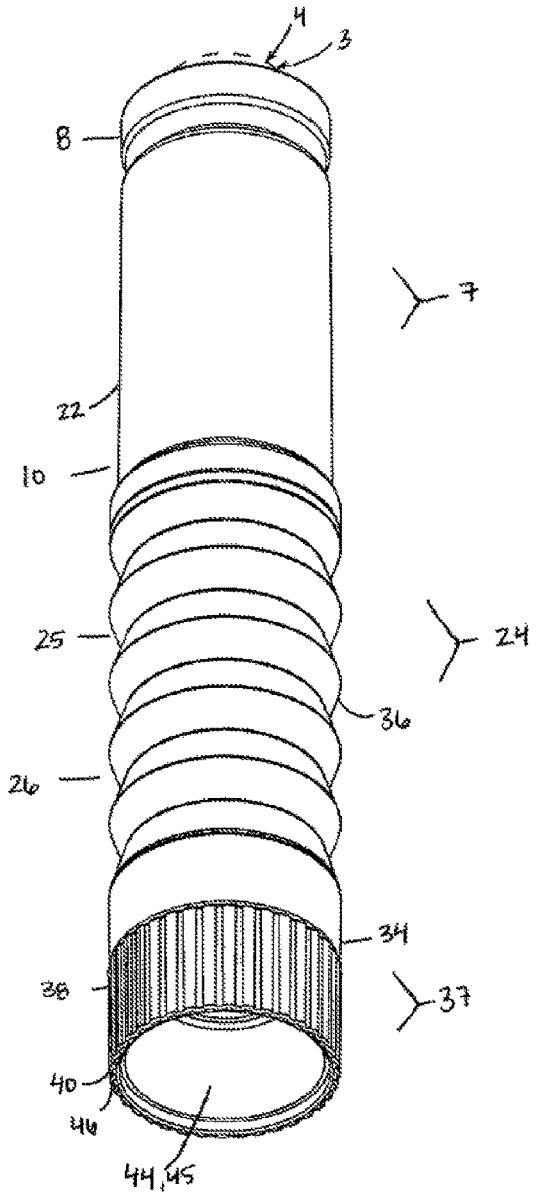
FIG. 4 is a diagrammatic bottom perspective view of the embodiment of FIG. 1 depicting the present invention in a decompressed state.
Figure 5:
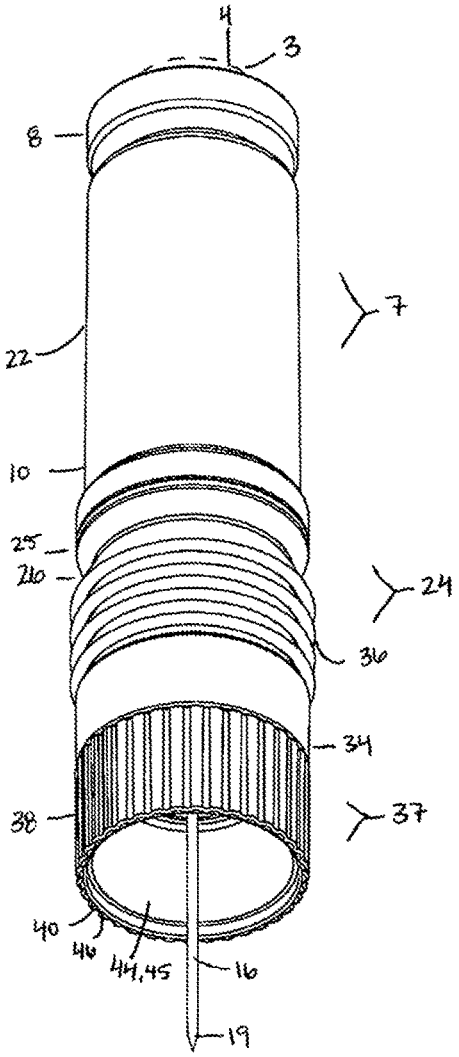
FIG. 5 is a diagrammatic bottom perspective view of the embodiment of FIG. 1 depicting the present invention in a compressed state.

Since compressed fluid containers 3 may vary in shape, additional protuberances may be implemented into the internal cavity of the top portion so as to position or support the compressed fluid container 3. However, these positioning protuberances 23 should not hinder the path or the ability of the compressed fluid container 3 to slide back to its resting position when manual pressure is released by the user, nor should the positioning protuberances 23 hinder ability of the compressed fluid container 3 to slide into its engaged position when manual pressure is applied by the user. In a preferred embodiment, these protrusions are tapered to allow for the container 3 to slide back into a resting position, so sealing of the valve is not hindered. FIG. 2 is a top view of the extractor device showing exemplary placement of the positioning protuberances 23.

Figure 8:
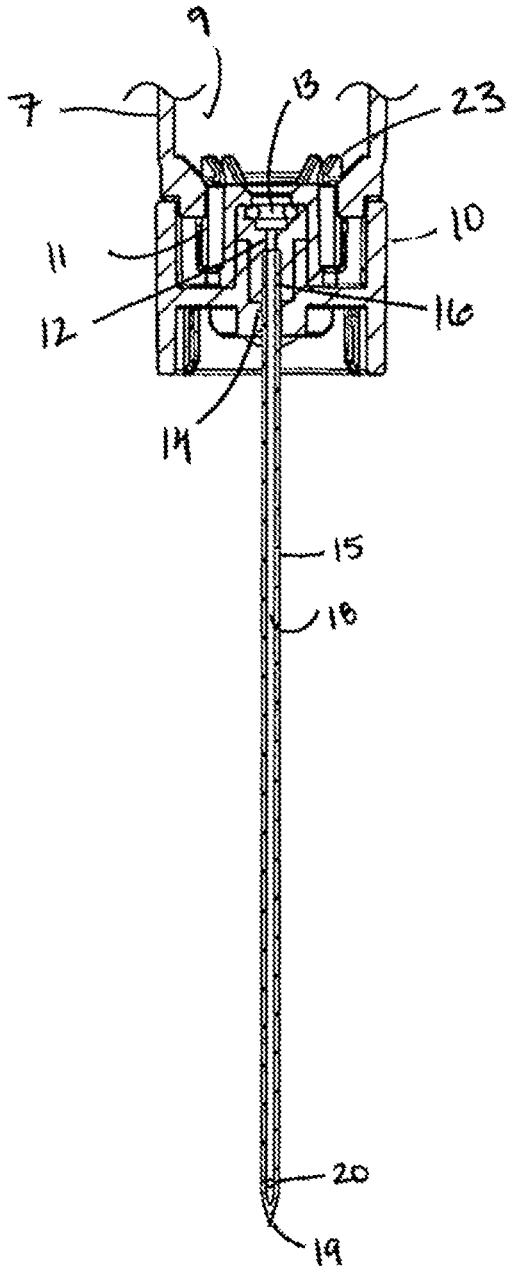
FIG. 8 is a diagrammatic side sectional view of a cutout of the embodiment of FIG. 1 depicting an exemplary needle assembly.
Figure 9:
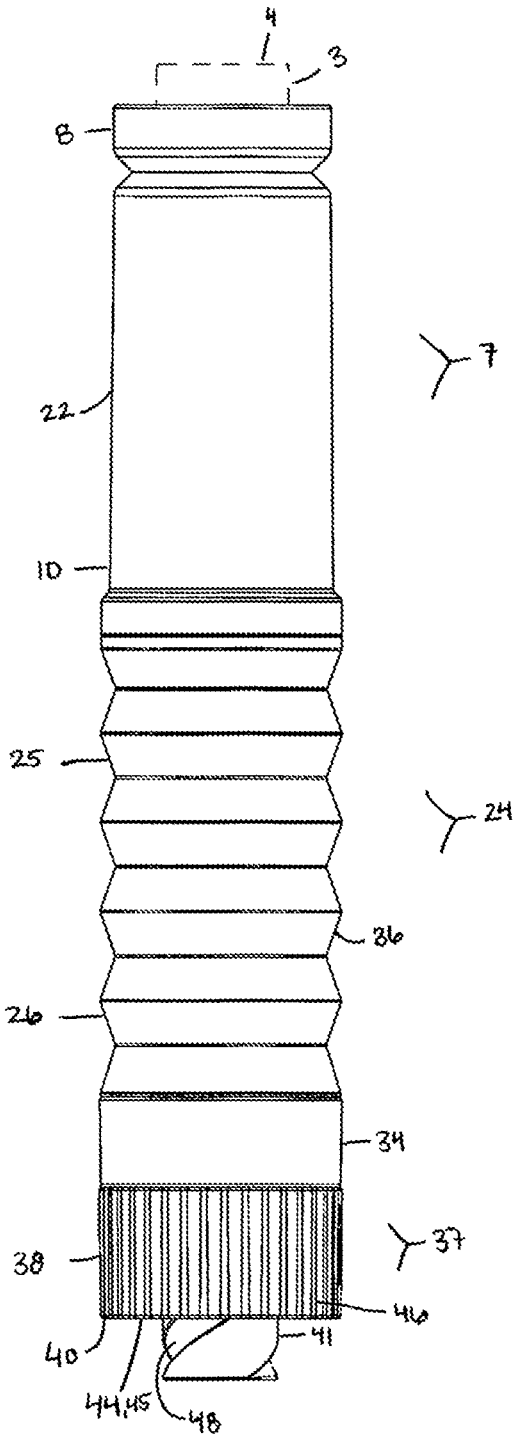
FIG. 9 is a diagrammatic front view of an alternate exemplary embodiment of the present invention depicting an extracted cork removal mechanism.
Figure 10:
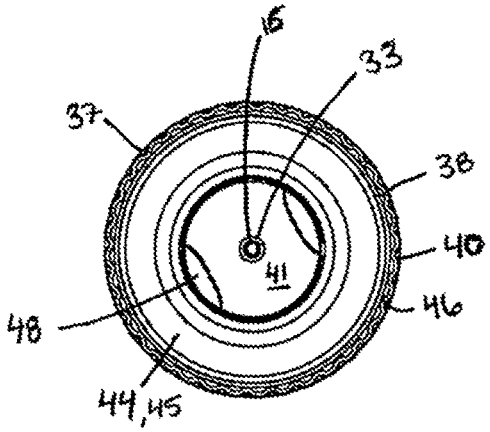
FIG. 10 is a diagrammatic bottom view of the embodiment of FIG. 9 depicting the cork remover mechanism retracted.
Figure 11:
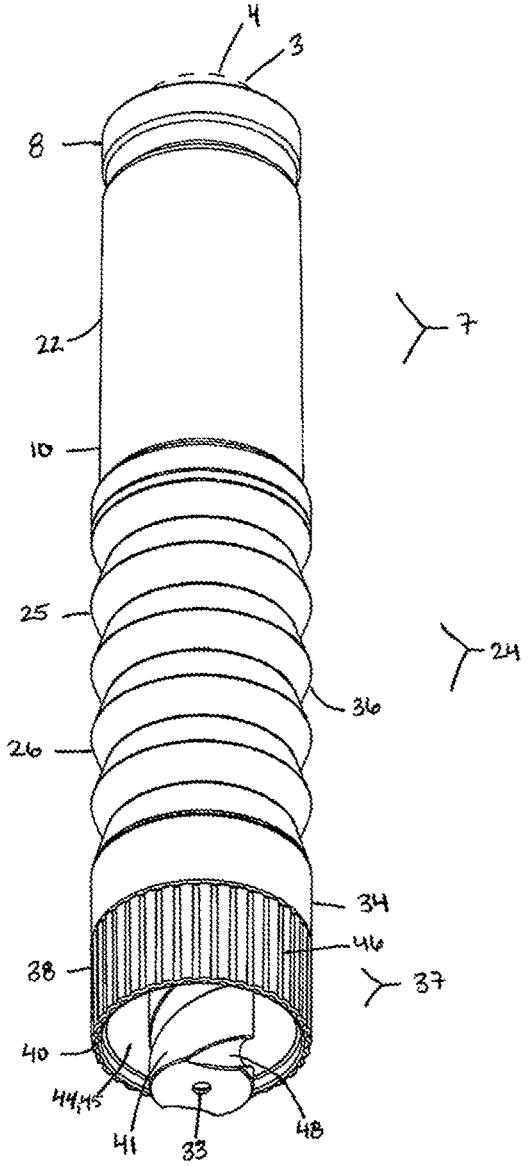
FIG. 11 is a diagrammatic bottom perspective view of the embodiment of FIG. 9 depicting the present invention in a decompressed state with the cork remover mechanism extended.

The lower end 10 of the containing section 7 includes a needle assembly 11 and a fluid channel 12. FIG. 8 is a sectional cutout view depicting the needle assembly 11 and fluid channel 12. The fluid channel 12 has an inlet cavity 13 dimensioned to removably receive at least part of the length of the outlet tube 6 of the compressed fluid container 3. The lower end 10 of the inlet cavity 13 has an opening extending into a fluid channel 12 of a diameter smaller than the outlet tube 6, thereby forming an abutment for the outlet tube 6 at the bottom of the inlet cavity 13. The walls of the inlet cavity 13 position the outlet tube 6 such that the outlet tube 6 aligns with the fluid channel 12 at the lower end 10 of the inlet cavity 13 for efficient flow of fluid. In operation, when the compressed fluid container 3 is pressed down by the user, the outlet tube 6 abuts against the bottom of the inlet cavity 13 creating the force needed to depress the outlet tube 6 into the compressed fluid container 3, actuating the valve, and releasing the fluid from the outlet tube 6 through the inlet cavity 13 into the fluid channel 12. One skilled in the art shall take care to dimension the inlet cavity 13 to only partially receive the length of the outlet tube 6 sufficient to receive the outlet tube 6 and position the compressed fluid container 3, but to avoid other components of the compressed fluid container 3 abutting against the inlet cavity 13 walls thereby restricting the depression of the outlet tube 6.

The blunt end 16 of a hollow needle 15 shall be affixed to the outlet 14 of the fluid channel 12 creating a continuous fluid path for the fluid to pass from the compressed fluid container 3 to the wine bottle 1 through the outlet tube 6, fluid channel 12, and needle 15. The connection shall be tight to minimize leakage and shall substantially align the fluid channel 12 with the needle inlet hole 17 to maximize fluid flow. In an exemplary embodiment, the needle 15 has a smooth finish and the two components are mated by press fitting them together. It is of no consequence whether the needle 15 is the male or female counterpart, so long as the fluid can pass from the fluid channel 12 through the needle 15. This may be accomplished by closely sliding the needle 15 within the fluid channel outlet 14 or having the fluid channel 12 terminate in a downwardly protruding tube that slides in the needle inlet hole 17. In an alternate embodiment, the needle 15 may have a threaded finish and is screwed into the fluid channel outlet 14 to achieve this tight connection.

Sliding Section 24

Figure 6:
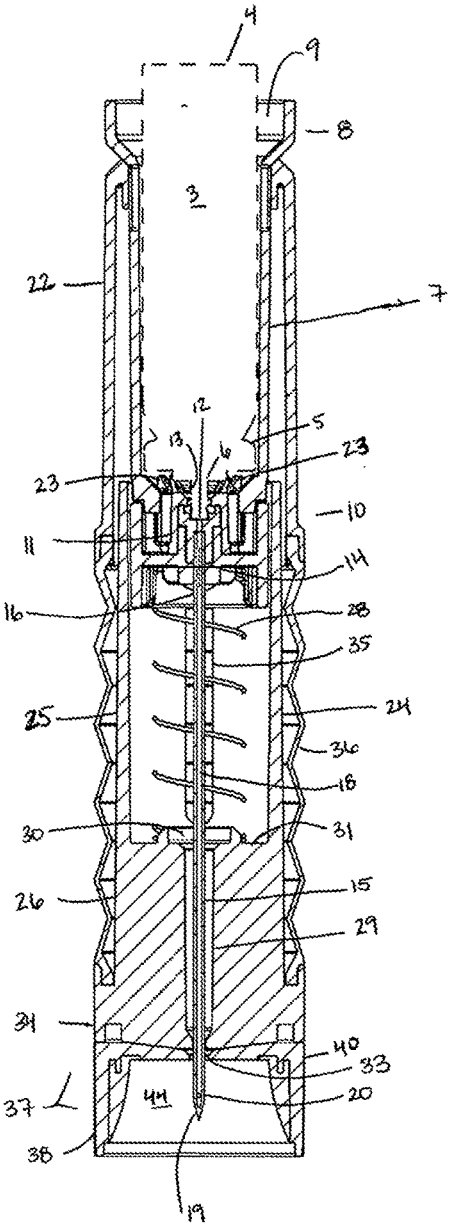
FIG. 6 is a diagrammatic side sectional view of the embodiment of FIG. 1 depicting the present invention in a decompressed state.

The sliding section 24 has a first portion 25 having an open interior 27, second portion 26, and a resistance means 28, as depicting in FIG. 6. The open interior 27 of the first portion 25 is adapted to slidably engage with the containing section 7. In an exemplary embodiment, the perimeter of the sliding portion is slightly larger than the perimeter of the containing section 7 to allow the first portion 25 to receive the perimeter of the sliding section 24. For ease of demonstration, FIGS. 5, 6, 15-18 depict an exemplary embodiment, wherein the containing section 7 and the sliding section 24 are tubular with a circular cross-section. As follows, the containing section 7 has an outer diameter smaller than the inner diameter of the sliding section 24 to allow the sections to coaxially slidably engage in an up and down linear motion with or against the resistance means 28. However, unless otherwise disclosed herein, one skilled in the art can construct components with a variety of cross-sectional shapes.

The needle 15 passes through the sliding section 24 to access the cork 2. Therefore, the second portion 26 of the sliding section 24 has a centrally disposed needle passageway 29 having a needle inlet 30 affixed to the extractor device body by a needle inlet support 31 extending substantially across an entire cross-section of the sliding section 24. The needle passageway 29 shall have a cross-section larger than the diameter of the needle 15 to maintain a spatial separation from the needle 15 on all sides to allow the needle 15 to extend and retract axially. In some embodiments, the needle passageway 29 may abut against the cork 2. In such embodiments, the cross-section of the needle passageway 29 should also be dimensioned smaller than the cork 2 diameter.

Figure 7:
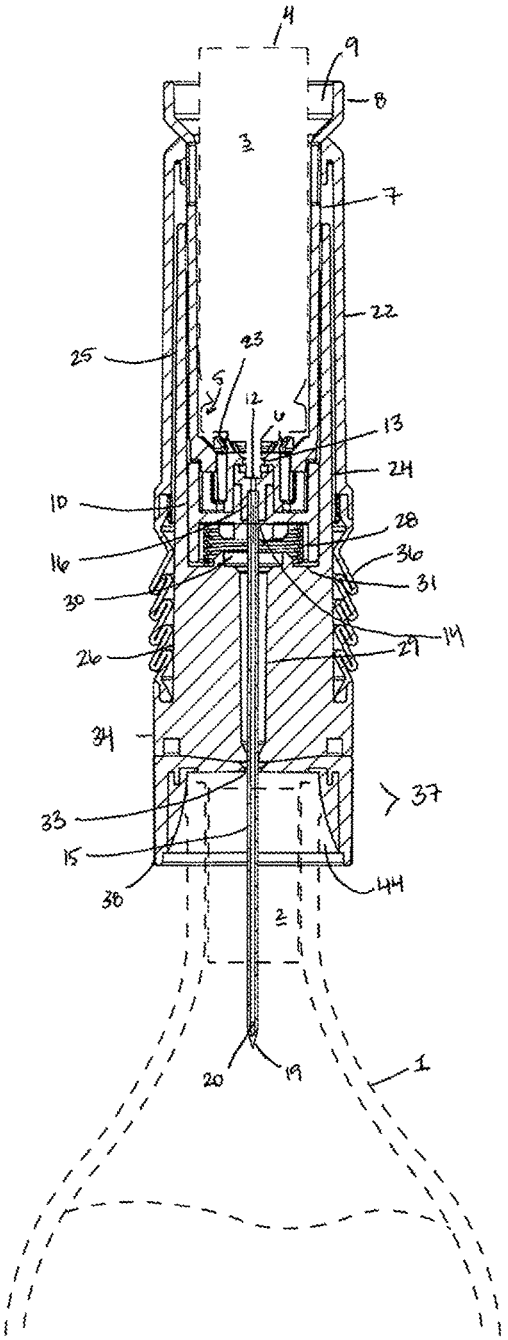
FIG. 7 is a diagrammatic side sectional view of the embodiment of FIG. 1 depicting the present invention in a compressed state and engaged with a corked bottle.
Figure 16:
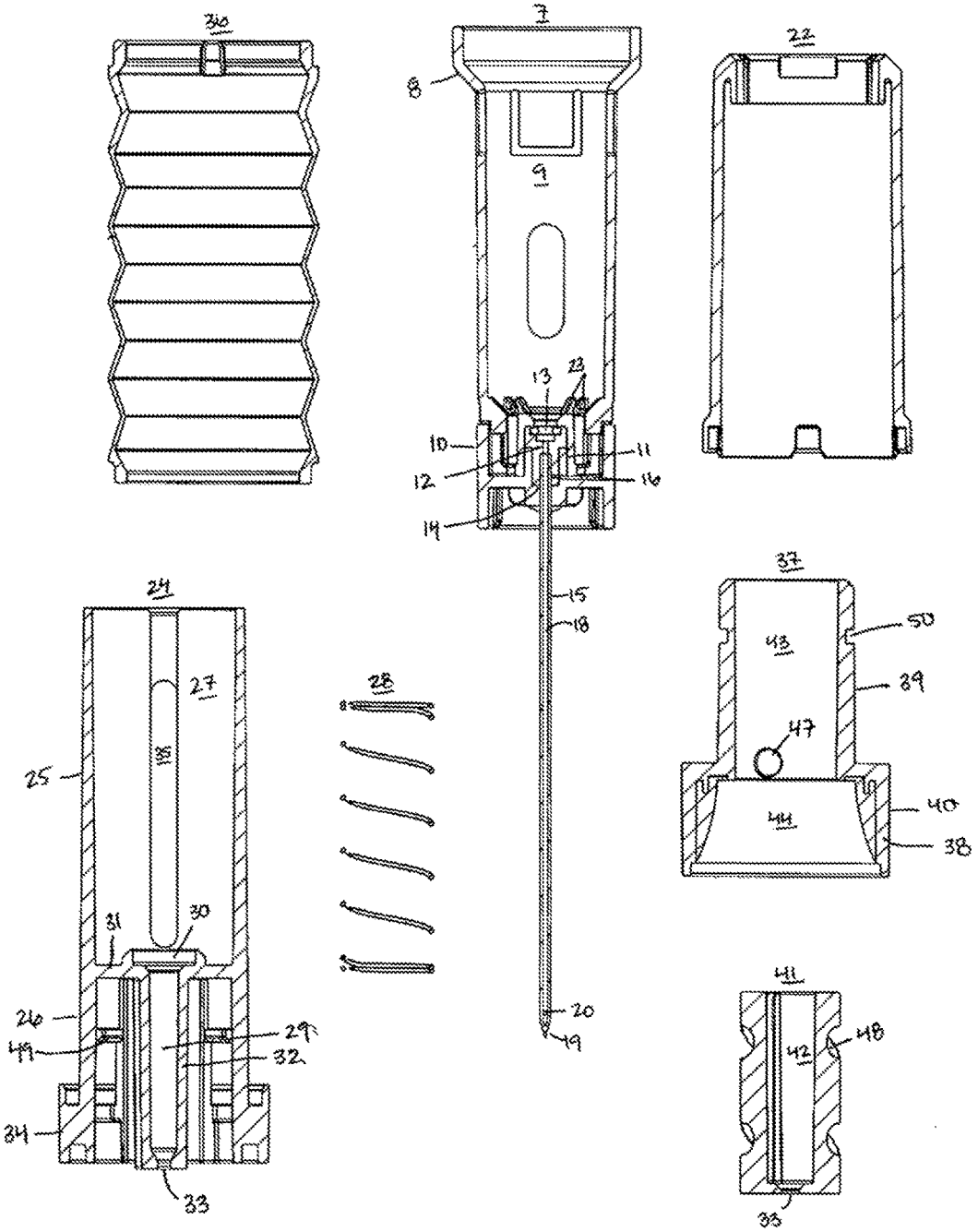
FIG. 16 is an exploded sectional side view of the embodiment of FIG. 15.

The needle inlet support 31 comprises an abutment against which the needle assembly 11 is restricted when the sliding section 24 is driven downward, as depicted in FIG. 7. Therefore, at least the needle inlet 30 must be affixed to the sliding section 24 by the needle inlet support 31, however the needle inlet support 31 may extend along the thickness of the second portion 26 along the length of the needle passageway 29 terminating at a needle outlet 33, as depicted in FIGS. 6 and 7. In an alternate embodiment, the needle inlet support 31 extends substantially across the cross-section of the sliding section 24 at the needle inlet 30 to support the resistance means 28 and the needle passageway 29 may comprise a support tube 32 extending downwardly from the needle inlet 30, as depicted in FIG. 16.

Resistance Means 28

In this first embodiment of the extractor device, the open interior 27 of the first portion 25 further houses a resistance means 28. The resistance means 28 can be any resilient device or mechanical feature that urges the extractor device to a decompressed state in which the containing section 7 is separated from the positioning section 37. FIGS. 4, 6, and 15-18 depict an exemplary embodiment wherein the resistance means 28 is a helical spring is coaxially displaced about the needle.

Positioning Section 37

The positioning section 37 of the extractor device has an exterior section 40 including a lip 38 extending down from the second end 34 of the sliding section 24 with an exterior inner cavity 44 that may be cylindrical or dimensioned to widen towards its bottom, wherein at least part of the exterior inner cavity 44 is dimensioned to receive the circumference of the bottleneck 1 and extends at least partially down the bottleneck 1. When the user places the extractor device over the bottleneck 1, the lip 38 positions the bottleneck 1 such that the needle 15 is centrally positioned over the cork 2. When the user applies a downward force to the containing section 7, the exterior inner cavity 44 of the positioning section 37 abuts against the bottleneck 1 as the needle 15 continues its downward path to penetrate the cork 2, as depicted in FIG. 7. This downward force stabilizes the bottle 1 against the surface on which it is held, allowing for the downward motion to be accomplished by a single hand. In a preferred embodiment, the exterior inner cavity 44 has an interior surface 45 of a flexible, elastic, resilient material (e.g. elastomer) to cushion and grip the bottleneck 1 to enhance stability and reduce contact between the bottleneck 1 and the rigid material composing the components of the extractor device.

Remover

FIGS. 9-13 depict a second embodiment of the extractor device, wherein the primary function is to remove the extracted cork 2 from the needle 15 whereupon it has been displaced during the extraction. All reference numbers are each selected to denote the same function as in the prior embodiments and are incorporated by reference herein. In this embodiment of the invention, the positioning section 37 has an interior section 39, an exterior section 40, and a tubular sleeve 41. In the preferred embodiment, the positioning section 37 has a substantially circular cross-section. The interior section 39 is defined as a portion of the positioning section 37 that fits within the second portion 26 of the sliding section 24 from the lower end 10 of the sliding section 24 up towards the needle inlet support 31. The interior section 39 has a rotational connection to the sliding section 24.

In an exemplary embodiment, the rotational connection is achieved between the interior section 39 and the second portion 26 of the sliding section 24 via a planar rim 49 protruding from one component received by a corresponding planar groove 50 in the other component. FIGS. 13-17 depict a configuration in which the planar rim 49 extends inwardly in the second portion 26 of the sliding section 24 and the exterior inner cavity 44 comprises the corresponding planar groove 50.

The interior section 39 has a hollow inner cavity 9 within which the tubular sleeve 41 is rotationally connected such that the hollow interior 42 of the tubular sleeve 41 at least partially aligns with the needle inlet 30. In one exemplary embodiment, the hollow interior 42 of the tubular sleeve 41 defines the needle passageway 29. However, FIGS. 13-17 depict a preferred embodiment in which the needle inlet support 31 further comprises a downwardly projecting support tube 32 to encompass the needle passageway 29 about which the tubular sleeve 41 is displaced.

In operation, the tubular sleeve 41 moves along an axial path and this support tube 32 protects the needle 15 by creating barrier from any moving components of the device. As a user rotates the exterior section 40, the entire positioning section 37 rotates, including the interior inner cavity 43 and therefore the interior inner cavity protuberance 47, which is engaged to the helical groove 48 on the exterior of the tubular sleeve 41. As the interior inner cavity protuberance 47 rotates the helical groove 48 travels along the protuberance resulting in axial displacement of the tubular sleeve 41.

Figure 12:
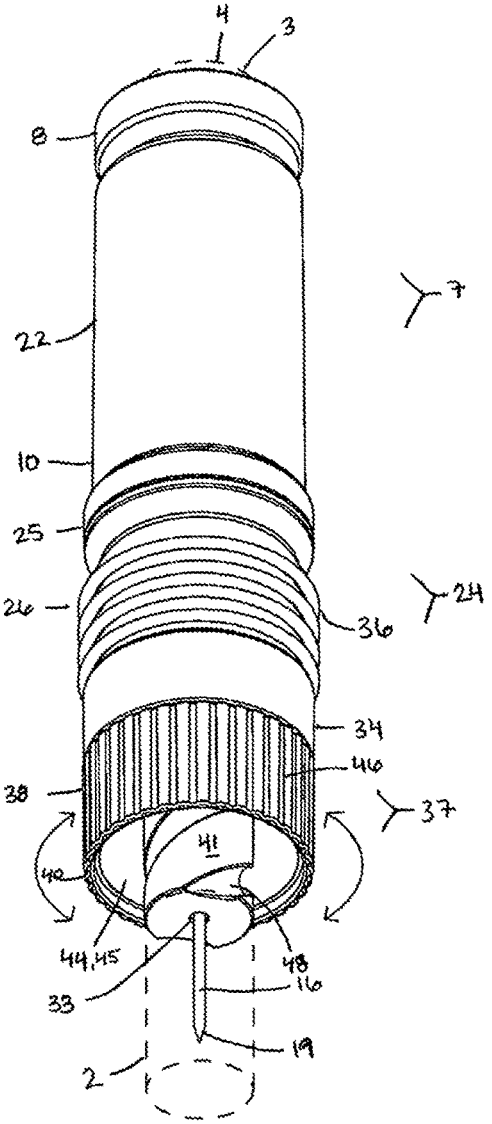
FIG. 12 is a diagrammatic bottom perspective view of the embodiment of FIG. 9 depicting the present invention in a compressed state with the cork remover mechanism engaged with a cork.
Figure 13:
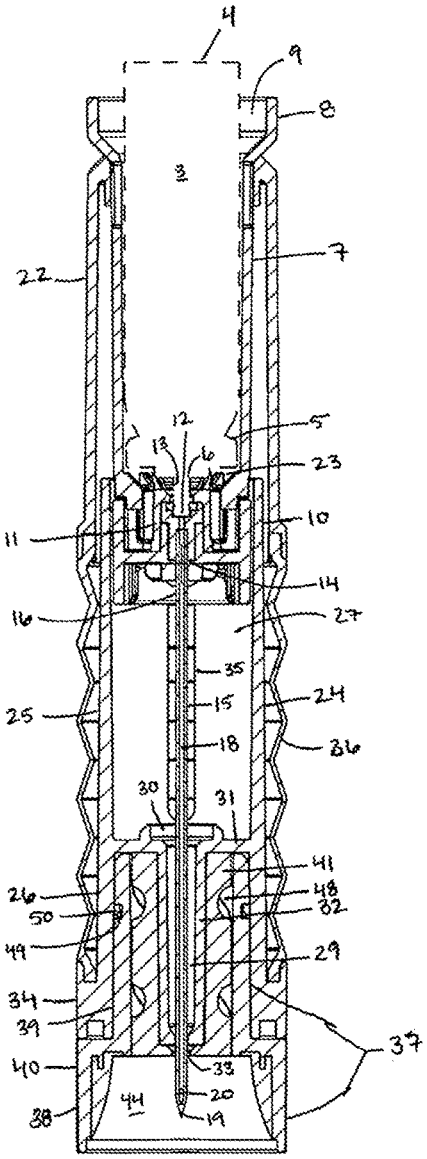
FIG. 13 is a diagrammatic side sectional view of the embodiment of FIG. 9 depicting the present invention in a decompressed state with the cork remover mechanism retracted.
Figure 14:
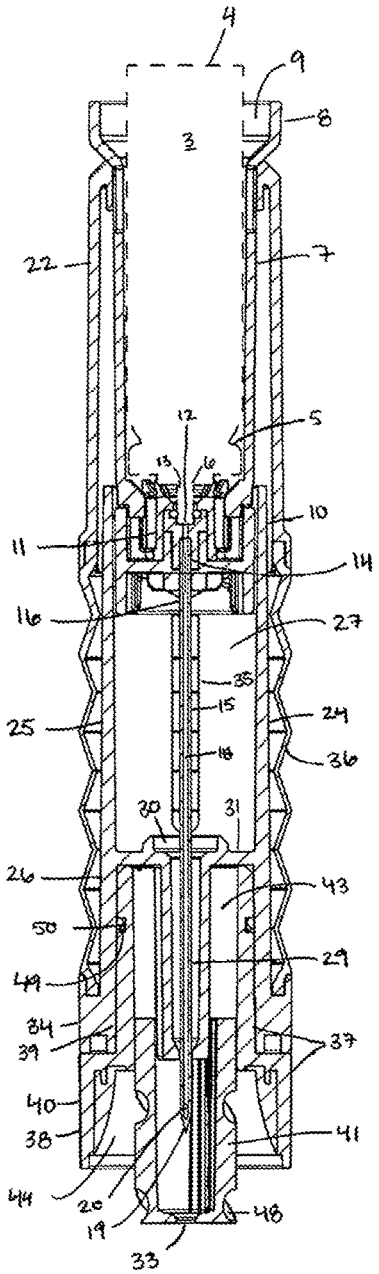
FIG. 14 is a diagrammatic side sectional view of the embodiment of FIG. 9 depicting the present invention in a decompressed state with the cork remover mechanism extended.

Depending on the orientation of the helical grooves 48, rotation of the exterior section 40 in a first direction (either clockwise or counter-clockwise) will cause the tubular sleeve 41 to extend downward beyond the interior inner cavity 43. By alternating the direction of rotation, the user can thereby retract the tubular sleeve 41 within the interior inner cavity 43. As the cork 2 is removed it is displaced along the needle 15, the user can extend the tubular sleeve 41 to abut against the removed cork 2 and apply force to dislodge the cork 2 from the needle 15, as depicted in FIG. 12. In a preferred embodiment, there are a plurality of interior inner cavity protuberances 47 and corresponding helical grooves 48 to provide increased stability and force against the removed cork 2. In an exemplary embodiment, the exterior section 40 has an exterior surface 46 configured to improve the user's drip on the exterior section 40 thereby facilitated the requisite force needed to displace the removed cork 2. FIGS. 1, 2, 3, 9, 11, 12, 17, and 18 depict a ribbed exterior surface 46. Other embodiments could include an exterior surface 46 of a flexible, elastic, resilient material (e.g. elastomer).

Figure 15:
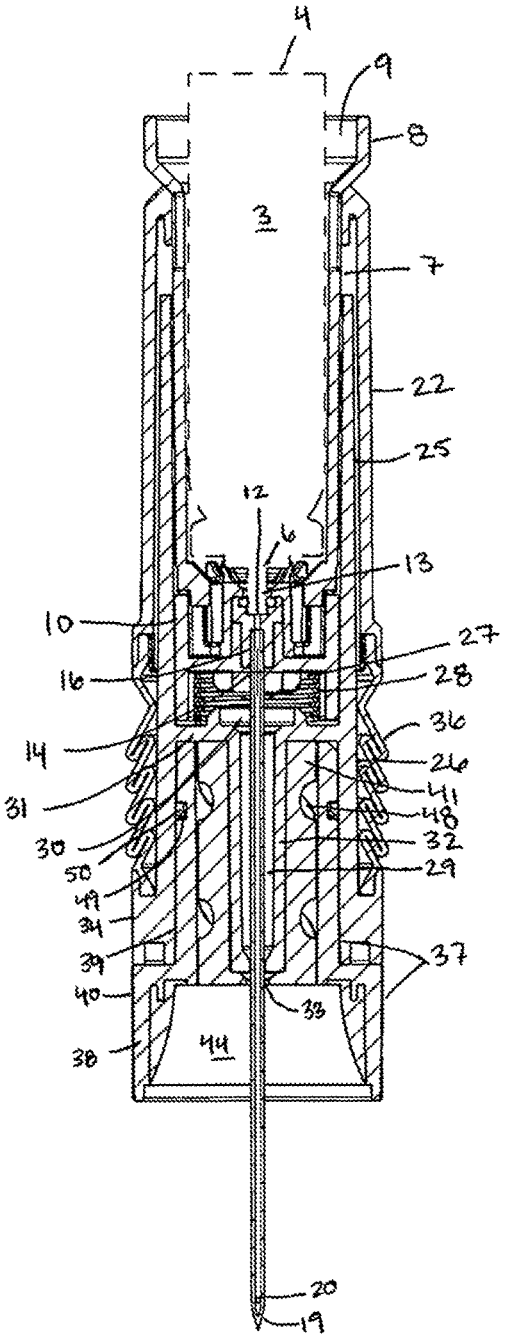
FIG. 15 is a diagrammatic side sectional view of a further alternate exemplary embodiment of the present invention depicting the present invention in a compressed state.
Figure 17:
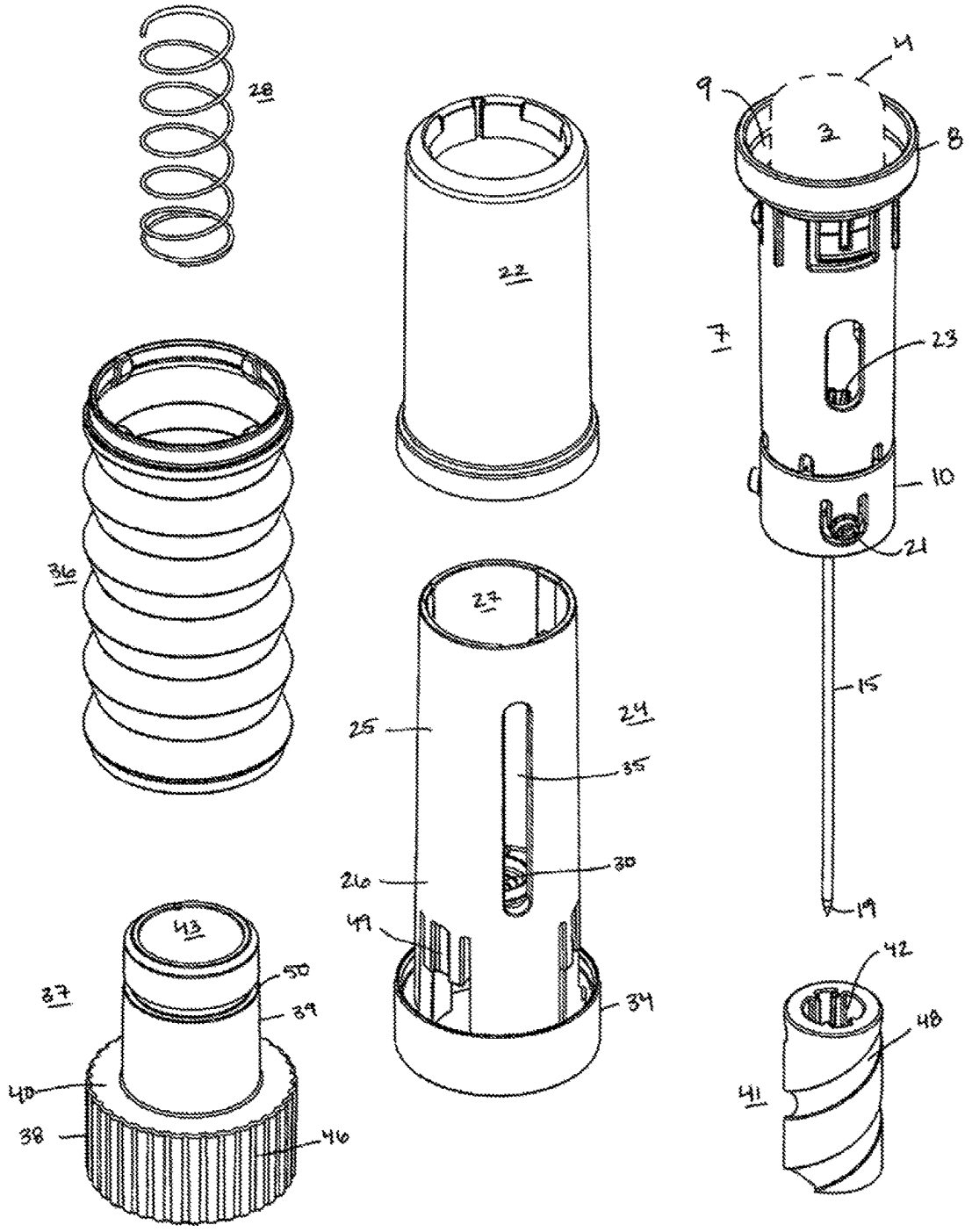
FIG. 17 is a diagrammatic exploded top perspective view of the embodiment of FIG. 15.

FIGS. 15-17 depict a third embodiment exploiting the primary functions of the first and second embodiments. All reference numbers are each selected to denote the same function as in the prior embodiments and are incorporated by reference herein.

Other Considerations

Many changes can be made to the various embodiments without departing from the spirit and scope of the invention. For example, in a preferred embodiment, the containing section 7, sliding sleeve, tubular sleeve 41, fluid channel 12, and positioning section 37 are preferably thermo-plastic resin. However, these rigid parts can be formed of any material or manufacturing method that provide one skilled in the art with components strong enough to withstand the force of penetrating the cork 2 and the user's grip.

Varying Height of Second Section of Sliding Section 24

In another exemplary change, the height of the second section of the sliding section 24 may be varied. As described herein, the needle inlet support 31 creates an abutment for the needle assembly 11 when the extractor device is in a compressed state. Since the needle 15 is readily available for consumers, one skilled in the art shall dimension the length of the first portion 25 of the sliding section 24 for proper placement of the needle 15 in the open space within the wine bottle 1 when the extractor device is compressed, as depicted in FIG. 7. For a first embodiment, wherein the needle support extends through the length of the second section of the sliding section 24, one skilled in the art may also manipulate the length of the second section to achieve proper needle 15 penetration. In a second embodiment, wherein the tubular sleeve 41 must be of a length sufficient such that when the tubular sleeve 41 is fully extended, the exposed needle 15 is of a length less than the length of a cork 2, manipulating the length of the second section of the sliding section 24 is not a preferred option for one skilled in the art practicing this invention.

Protruding Guide 21 and Elongated Path 35

Figure 18:
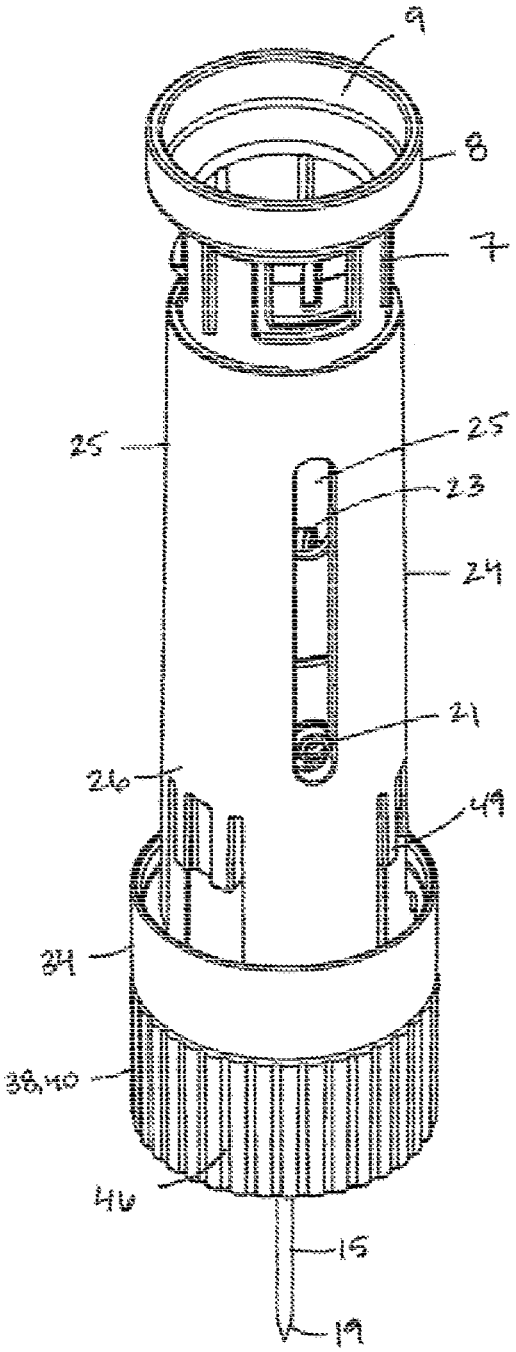
FIG. 18 is a diagrammatic top perspective view of the embodiment of FIG. 1 or FIG. 9 depicting the present invention in a compressed state without a jacket or sheath.

Additionally, many features can be added without departing from the spirit and scope of the invention. For example, FIGS. 16-18 depict a guided path along which the containing section 7 slides within the sliding section 24. In these exemplary embodiments, the containing section 7 maintains a linear path within the sliding section 24 by including an exteriorly protruding guide 21 that fits within and slides along an elongated path 35 along the sliding section 24 that is adapted to receive the protruding guide 21. In a preferred embodiment, the elongated path 35 shall extend longitudinally along the length of the sliding section 24, such that when the containing section 7 is driven down to a compressed state, the protruding guide 21 slides along the elongated path 35 to maintain an axial movement during the entire upward and downward sliding motion. FIG. 16-18 depict the elongated path 35 as a slot, however the elongated path 35 could be a similar opening such as a groove or notch or a narrow elongated depression.

Jacket 22

In another exemplary feature, a jacket 22 encompasses the containing section 7, as depicted in FIGS. 1-17. In operation, the user applies the requisite downward force by gripping the upper end 8 of the containing section 7. Because the containing section 7 slides within the sliding section 24, for optimal use, the user must apply the requisite downward force by gripping the upper end 8 of the containing section 7 to avoid interfering with the sliding section 24. While the extractor remains operable in this configuration, as depicted in FIG. 18, in a preferred embodiment of the present invention, an outer jacket 22 at least partially coaxially encases the containing section 7 from the upper end 8. The jacket 22 is spaced from the containing section 7 to allow the sliding section 24 to slide therebetween. Thus, the user can grip the jacket 22 at any longitudinal location without interfering with the sliding or the risk of pinching their skin between the containing section 7 and the sliding section 24 when using the extractor device.

Sheath 36

Similarly, in some embodiments, a sleeve comprised of flexible, elastic, resilient material may be attached to substantially coaxially encase the sliding section 24 when the cork 2 extractor is in a decompressed state as depicted in FIGS. 1-17. The sleeve shall be adapted to collapse and extend as the sliding section 24 and containing section 7 are slidably engaged. In a preferred embodiment, the sleeve shall be composed of elastomer and affixed to the lower end 10 of the containing section 7 and the second end 34 of sliding section 24. FIG. 18 depicts an exemplary embodiment without the sheath 36.

It is understood that the present invention is not limited to the embodiments described within the scope of the following claims.

What is claimed is:

1. A cork extractor device for use with a removable compressed fluid container having a substantially cylindrical body, an outlet tube, and a self-contained valve actuated by depressing said outlet tube, therein comprising:

an elongated body having a containing section, a sliding section, and a positioning section;

said containing section having a substantially circular cross-section having a length, an upper end being open, an inner cavity adapted to removably receive said container, and a lower end comprising a needle assembly extending across substantially said cross section of said lower end;

said needle assembly comprising a fluid channel having an inlet cavity and an outlet; said inlet cavity adapted to a partially receive the length of said outlet tube, said fluid channel having a diameter smaller than an inner diameter of said outlet tube, wherein when said outlet tube is positioned in said inlet cavity and said container is forced downward, said outlet tube abuts against said fluid channel releasing fluid into said fluid channel; and a needle having a hollow longitudinal passageway being operatively connected to said fluid channel outlet and of sufficient length to axially traverse downstream of said fluid channel to receive fluid therefrom and pass said fluid through the length of a cork into a bottle when said extractor is in a compressed state;

said sliding section comprising a first portion, a second portion, and a resistance means for urging said containing section from said positioning section;

said first portion is disposed adjacent to said lower end of said containing section, having an open interior and adapted to slidably engage with said containing section; and said second portion terminating at a second end having a centrally disposed needle passageway of sufficient diameter to spatially relate from said needle, said needle passageway extending from a needle inlet; said needle inlet comprising a needle inlet support extending substantially across an entire cross-section of said sliding section; and said positioning section comprising an exterior section having a lip disposed adjacent to said second end of said sliding section and extending substantially linearly downward defining an exterior inner cavity dimensioned to receive the circumference of a bottleneck within and extend at least partially downward over said bottle neck to coaxially position said needle over said cork;

wherein, when said exterior inner cavity of said positioning section engages said bottleneck and a downward force is applied, said containing section slides along at least part of the length of said first section of said sliding section towards said cork and against said resistance means, said needle is driven through said cork, and when said container is subsequently forced downward, said outlet tube depresses to release said fluid into said bottle increasing the pressure therein and ejecting said cork upon said needle.

2. The extractor device of claim 1 wherein said length of said containing section is dimensioned such that when said container is fully received, with said outlet tube being coupled to said inlet cavity, a top portion of said container extends at least minimally above said upper end of said containing section.

3. The extractor device of claim 1 wherein said resistance means comprises a helical spring coaxially disposed about said needle and resting on said needle inlet support.

4. The extractor device of claim 1 wherein said needle comprises a blunt end having an inlet hole, a piercing end with a proximal outlet hole, and said hollow passageway therebetween, said blunt end being press-fitted to said fluid channel wherein said fluid channel substantially aligns with said inlet hole to facilitate fluid flow.

5. The extractor device of claim 1 wherein said first section of said sliding section is dimensioned to closely slidably receive an outer perimeter of said containing section.

6. The extractor device of claim 5 wherein said containing section further comprises an exteriorly protruding guide, and said sliding section further comprises a corresponding narrow elongated path extending at least partially along the length of said sliding section and adapted to receive said protruding guide, to facilitate said containing section sliding long a linear path.

7. The extractor device of claim 5 further comprising a jacket coaxially disposed adjacent to said upper end and extending downward at least partially about said containing section, dimensioned such that said sliding section slidably engages between said containing section and said jacket.

8. The extractor device of claim 1 further comprising a sheath disposed about a substantial length of said sliding section, said sheath comprising a resilient material and being adapted to collapse when said extractor device is in a compressed state and expand when said extractor device returns to a decompressed state.

9. The extractor device of claim 1 wherein said inner cavity of said containing section further comprising at least one positioning protuberance to position said container.

10. The extractor device of claim 1 wherein said needle passageway further comprises a support tube downwardly projecting from said needle inlet support and terminating at a needle outlet having a diameter less than the diameter of said cork to create an abutment against said cork; wherein said tubular sleeve is coaxially disposed about said needle passageway at least to said needle outlet.

11. The extractor device of claim 1 wherein said positioning section further comprising an interior section and a tubular sleeve, wherein said positioning section having a substantially circular cross section and being rotationally engaged to said sliding section;

said interior section disposed within said second portion of said sliding section, wherein said interior section extends substantially from said second end of said sliding section towards said needle inlet support defining an interior inner cavity containing said needle passageway and said tubular sleeve therein;

said tubular sleeve is coaxially disposed about said needle passageway, wherein said tubular sleeve is dimensioned to extend longitudinally along said needle passageway at least to said needle outlet;

said tubular sleeve having at least one helical groove extending longitudinally around the exterior length of said tubular sleeve; and said interior inner cavity having a protuberance corresponding to said at least one helical groove to rotationally drive said tubular sleeve in an axial direction when said positioning section is rotated;

wherein, when exterior section of said positioning section is rotated, said tubular sleeve traverses downward along said needle abutting against said removed cork to facilitate removal of said cork from said needle.

12. The extractor device of claim 11 wherein said lower end of said sliding section further comprising a planar rim protruding inward, and the exterior of said interior section of said positioning section further comprising an planar groove corresponding to said planar rim to facilitate rotational movement when said positioning section is manually rotated.

13. The extractor device of claim 11 wherein said exterior section further comprising an exterior surface configured to facilitate a user's grip.

14. A cork extractor device for use with a removable compressed fluid container having a substantially cylindrical body, an outlet tube, and a self-contained valve actuated by depressing said outlet tube, therein comprising:

an elongated body having a containing section, a sliding section, and a positioning section;

said containing section having a substantially circular cross section having a length, an upper end being open, an inner cavity adapted to removably receive said container, and a lower end comprising a needle assembly extending across substantially said cross section of said lower end;

said needle assembly comprising a fluid channel having an inlet cavity and an outlet; said inlet cavity adapted to a partially receive the length of said outlet tube, said fluid channel having a diameter smaller than an inner diameter of said outlet tube, wherein when said outlet tube is positioned in said inlet cavity and said container is forced downward, said outlet tube abuts against said fluid channel releasing fluid into said fluid channel; and a needle having a hollow longitudinal passageway being operatively connected to said fluid channel outlet and of sufficient length to axially traverse downstream of said fluid channel to receive fluid therefrom and pass said fluid through the length of a cork into a bottle when said extractor is in a compressed state.

said sliding section comprising a first portion and a second portion; and said first portion is disposed adjacent to said lower end of said containing section, having an open interior and adapted to slidably engage with said containing section;

said second portion terminating at a second end comprising a centrally disposed needle passageway of sufficient diameter to spatially relate from said needle and further comprising a needle inlet extending downward to terminate at a needle outlet at said second end; said needle inlet further comprising a needle inlet support extending substantially across an entire cross-section of said sliding section; and said needle outlet having a diameter less than the diameter of said cork to create an abutment against said cork;

said positioning section having a substantially circular cross section and being rotationally engaged to said sliding section, comprising an interior section, an exterior section, and a tubular sleeve;

said interior section disposed within said second portion of said sliding section, wherein said interior section extends substantially from said second end of said sliding section towards said needle inlet support defining an interior inner cavity containing said needle passageway and said tubular sleeve therein;

said exterior section comprising a lip disposed adjacent to said second end of said sliding section and extending substantially linearly downward defining an exterior inner cavity dimensioned to receive the circumference of a bottleneck within and extend at least partially downward over said bottleneck to coaxially position said needle over said cork;

said tubular sleeve is coaxially disposed about said needle passageway, wherein said tubular sleeve is dimensioned to extend longitudinally along said needle passageway at least to said needle outlet;

said tubular sleeve having at least one helical groove extending longitudinally around the exterior length of said tubular body; and said interior inner cavity having a protuberance corresponding to said at least one helical groove to rotationally drive said tubular sleeve in an axial direction when said positioning section is rotated;

wherein, when said exterior inner cavity of said positioning section engages said bottleneck and a downward force is applied, said containing section slides along the length of said first section of said sliding section towards said cork, said needle is driven through said cork, and when said container is subsequently forced downward, said outlet tube depresses to release said fluid into said bottle increasing the pressure therein and ejecting said cork upon said needle;

wherein, when exterior section of said positioning section is rotated, said tubular sleeve traverses downward along said needle abutting against said removed cork to facilitate removal of said cork from said needle.

15. The extractor device of claim 14 wherein said lower end of said sliding section further comprising a planar rim protruding inward, and the exterior of said interior section of said positioning section further comprising an planar groove corresponding to said planar rim to facilitate rotational movement when said positioning section is manually rotated.

16. The extractor device of claim 14 wherein said interior section of said positioning section further comprising a planar rim protruding exteriorly and the interior of said lower end of said sliding section further comprising a planar groove corresponding to said planar rim to facilitate rotational movement when said positioning section is manually rotated.

17. The extractor device of claim 14 wherein said exterior section further comprising an exterior surface configured to facilitate a user's grip.

18. The extractor device of claim 14 wherein said sliding section further comprises a resistance means for urging said containing section from said positioning section.

19. A method of using said extractor device of claim 14 to withdrawing a cork from a bottleneck and remove said cork from said needle, comprising:

positioning said container in said containing section such that said outlet tube is positioned in said inlet cavity;

positioning said exterior inner cavity of said positioning section over said bottle;

applying a downward force to said containing section causing said containing section to slide along at least part of the length of said first section of said sliding section towards said cork to drive needle through said cork;

applying a downward force to said container causing said outlet tube to abut against said fluid channel thereby depressing said outlet tube to release said fluid into said fluid channel, through said hollow needle, and into said into said bottle, thereby increasing the pressure therein and ejecting said cork upon said needle; and rotating said exterior section of said positioning section causing said tubular sleeve to transverse downward along said needle abutting against said removed cork to forcibly displace said cork from said needle.

20. A method for withdrawing a cork from a bottleneck of a bottle with a cork extractor device having a containing section, a sliding section, and a positioning section, for use with a removable compressed fluid container having a substantially cylindrical body, an outlet tube, and a self-contained valve actuated by depressing said outlet tube, therein comprising steps:

positioning said compressed fluid container within said containing section;

positioning said positioning section over said bottleneck extractor device;

applying a downward force to slidably engage said containing section along at least part of the length of said sliding section towards said cork and against a resistance means housed therein and drive said needle through said cork; and applying a downward force to said container causing said outlet tube to abut against said containing section releasing fluid through said needle into said bottle, thereby increasing the pressure therein and ejecting said cork upon said needle.

21. The method of claim 20 further comprising removing said extracted cork from said needle, by rotationally projecting a component of said extractor device downwardly along said needle to abut against said cork thereby forcibly displacing said cork from said needle.

* * * * *